United States Patent [19]

Fischer

[11] 4,269,080

[45] May 26, 1981

[54] COUPLING ARRANGEMENT FOR TRANSMITTING TORQUE

[76] Inventor: Artur Fischer, Weinhalde 34, 7244 Waldachtal 3 (Tumlingen), Fed. Rep. of Germany

[21] Appl. No.: 51,413

[22] Filed: Jun. 25, 1979

[30] Foreign Application Priority Data

Jul. 4, 1978 [DE] Fed. Rep. of Germany ..... 2829268

[51] Int. Cl.[3] ..... F16D 3/04; F16D 1/00; F16D 3/44

[52] U.S. Cl. ..... 74/425; 64/31

[58] Field of Search ..... 64/31, 17 R; 74/424.7, 74/425

[56] References Cited

U.S. PATENT DOCUMENTS

| | | | |
|---|---|---|---|
| 1,457,021 | 5/1923 | Davis et al. | 74/424.7 |
| 2,106,088 | 1/1938 | De Tar | 74/425 |
| 3,159,013 | 12/1964 | Mazziotti | 64/17 R |
| 3,429,144 | 2/1969 | McIntosh | 64/17 R |
| 4,167,859 | 9/1979 | Okuda | 64/17 R |

FOREIGN PATENT DOCUMENTS

| | | | |
|---|---|---|---|
| 567202 | 9/1975 | Sweden | 64/17 |

*Primary Examiner*—C. J. Husar
*Assistant Examiner*—Conrad Berman
*Attorney, Agent, or Firm*—Michael J. Striker

[57] ABSTRACT

A coupling arrangement for transmitting torque in a toy model has a Cardan joint whose one end portion is connected with a nut which is screwed on a worm gear mounted on a motor shaft, whereas the other end portion of the same is connected with a driving shaft engaging with a gearing element which is connected with a toy model axle. The nut may be formed as a cap nut and fixed on the worm gear by a counter nut. The gearing element may be formed by a gear wheel, a differential gear or the like. A structural plate may be provided, on which the motor and a structural element supporting the driving shaft can be mounted. The cap nut may have a closed end portion provided with a journal which is connected with one end portion of the Cardan joint.

9 Claims, 1 Drawing Figure

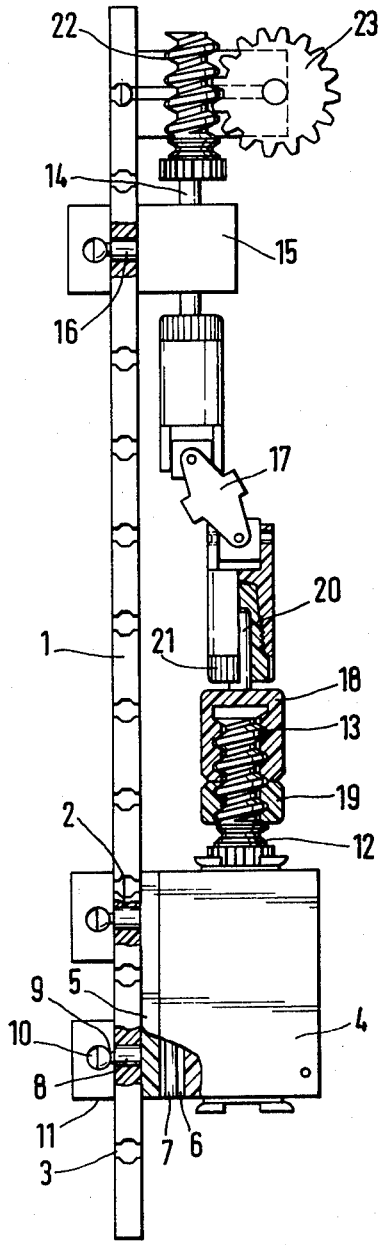
22
23
14
15
16
17
20
1
21
18
13
19
2
12
9
5
4
10
8
11
7
6
3

COUPLING ARRANGEMENT FOR TRANSMITTING TORQUE

BACKGROUND OF THE INVENTION

The present invention relates to a coupling arrangement for transmitting torque in a toy model. More particularly, it relates to a coupling arrangement for transmitting torque from a worm gear mounted on a shaft of a toy motor to a gearing element connected with an axle of a toy model.

In assembling of toy models having a motor which is connected with a gearing element seated on an axle, bulky and space-consuming auxiliary constructions are required for arresting of connecting means of structural elements of an assembly kit, so as to bring the motor axis to a region of engagement. In order to accommodate these auxiliary constructions it is necessary to provide, for example in toy vehicle models, a highly oversized wheel base which considerably affects the appearance of the models.

SUMMARY OF THE INVENTION

Accordingly, it is an object of the present invention to provide a coupling arrangement for transmitting torque in a toy model, which avoids the disadvantages of the prior art.

More particularly, it is an object of the present invention to provide a coupling arrangement which can be mounted on a worm gear of a motor shaft and transmit torque to a driving shaft, when the motor shaft and the driving shaft are offset relative to one another.

Another object of the present invention is to provide a coupling arrangement which is operative for transmitting torque from a motor shaft to a driving shaft of a toy model and at the same time is compact and space-economical.

In keeping with these objects and with others which will become apparent hereinafter, one feature of the present invention resides, briefly stated, in a coupling arrangement which includes a Cardan joint having two end portions, wherein one end portion of the Cardan joint is connected with a nut screwed on a worm gear of a shaft of a motor, whereas the other end portion of the Cardan joint is connected with a driving shaft engaging with a gearing element. The above-mentioned nut may be formed as a cap nut and fixed on the motor shaft by a counter nut. The driving shaft may be supported in a structural element which is mounted on a structural plate of the arrangement. The cap nut which has an inner thread matching the worm gear and is fixed on the latter by the counter nut has a force-locking connection with the motor shaft. The connection performed by the Cardan joint provides for transmission of torque from the motor to the driving shaft supported in the structural element. The thus-constructed arrangement reliably performs its intended functions and is compact.

In accordance with another feature of the present invention, the driving shaft has two end sections one of which extends outwardly beyond one end face of the structural element and engages with the gearing mounted on the axle. In such a construction the driving shaft can directly mesh wih a gear wheel forming the gearing element. Since the structural element serves only for supporting of the driving shaft, its outer dimension is considerably smaller than that of the motor. Thereby, it is accommodated in the toy model in a space-economical manner. It also becomes possible to arrange the driving shaft in toy vehicle models between the structural plate and the gearing element mounted on the vehicle axle. The inventive construction allows both upright displacement and lateral displacement so that optimum utilization of space is possible.

In accordance with still another feature of the present invention, the cap nut may have a closed end section provided with a journal or pin which is connected with a connecting portion of the Cardan joint. This connection may be performed by a locking nut. In such a construction it is possible to utilize an available Cardan joint which generally serves for pivotal connection of two axles. Moreover, the journal arranged on the cap nut offers a possibility that the motor shaft provided with the worm gear may also be equipped with a driving element such as a gear wheel, a grooved roller or the like.

BRIEF DESCRIPTION OF THE DRAWING

The single FIGURE of the drawing shows a coupling arrangement for transmitting torque in accordance with the present invention.

DESCRIPTION OF A PREFERRED EMBODIMENT

A coupling arrangement for transmitting torque in accordance with the present invention is mounted on a structural plate 1. The structural plate 1 is provided with openings 2 in its central region and with undercut grooves 3 in the region of lateral edges.

A housing 4 of a motor is mounted on the structural plate 1 with the aid of a plate member 5. The latter has undercut projections 7 at its one side and projections 8 at its other side. The motor housing 4, in turn, is provided with undercut grooves 6 in which the undercut projected 7 of the plate member 5 are engageable. Thereby, the motor housing 4 is connected with the plate member 5.

The projections 8 of the plate member 5 have end portions provided with undercuts 9. When the projections 8 of the plate member 5 pass through the openings 2 of the structural plate 1, the end portions of the projections 8 extend laterally outwardly beyond the structural plate 1. Structural blocks 11 having undercut grooves 10 are fitted onto the laterally projecting end portions of the projections 8 of the plate member 5. In assembled condition the undercut projections 7 of the plate member 5 engage in the undercut grooves 6 of the motor housing 4, and the structural blocks 11 are fitted onto the undercut end portions of the projections 8 of the plate member 5. Thereby the motor housing 4 is braced to the structural plate 1.

The motor has a shaft 12 extending outwardly beyond the housing 4 and provided with a worm gear 13. The worm gear 13 is firmly pressed on the shaft 12 of the motor.

A structural element 15 supports a driving shaft 14 and is mounted on the structural plate 1. The structural element 15 is provided with a projection 16 which also passes through the opening 2 of the structural plate 1 and extends outwardly beyond the latter. The end portion of the projection 16 is locked by the structural block which may be similar to the structural block 11.

The driving shaft 14 which is supported in the structural block 15 is connected with a motor shaft 12 by a Cardan joint 17 which allows an upright displacement and a lateral displacement of the driving shaft 14 relative to the motor shaft 12. The force-locking connection of the motor shaft 12 and the Cardan joint 17 is performed by a cap nut 18 which is fixed on the worm gear 13 by a counter nut 19. The cap nut 18 has a connecting end portion which is provided with a journal or a pin 20. A connecting portion of the Cardan joint 17 is fitted on the journal 20 and locked by a locking nut 21.

The force-locking connection of the Cardan joint 17 with the driving shaft 14 is performed in a similar manner. As can be seen from the drawing, the driving shaft 14 has an end section which extends outwardly beyond the structural element 15 and is connected with the Cardan joint 17. Thus, one end portion of the Cardan joint is connected with the motor shaft 12, whereas the other end portion of the Cardan joint is connected with the driving shaft 14.

The driving shaft 14 has another end portion which is opposite to the Cardan joint 17 and also extends outwardly beyond the structural element 15. The other end portion of the driving shaft 14 is connected with a worm gear 22 which engages a gearing element 23. The gearing element 23 is arranged on the axle of the vehicle. The gearing element 23 may be formed as a gear wheel, a grooved roller, a differential gear or the like.

It will be understood that each of the elements described above, or two or more together, may also find a useful application in other types of constructions differing from the types described above.

While the invention has been illustrated and described as embodied in a coupling arrangement for transmitting torque, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A coupling arrangement of a toy model for transmitting torque from a worm gear arranged on a shaft of a motor which is mounted on a structural plate, to a gearing element connected with an axle, comprising a Cardan joint having two end portions spaced from one another; first coupling means for coupling one of said end portions of said Cardan joint with the worm gear of the shaft of the motor, said first coupling means including a cap nut screwed on the worm gear of the shaft of the motor and connected with said one end portion of said Cardan joint, and a counter nut fixing said cap nut on said worm gear; and second coupling means for coupling the other of said end portions of said Cardan joint with the gearing element, said second coupling means including a structural element mounted on the mounting plate, and a driving shaft supported in said structural element, said driving shaft being connected with said other end portion of said Cardan joint and engaging the gearing element.

2. A coupling arrangement as defined in claim 1, wherein the gearing element is a gear wheel, said driving shaft engaging with said gear wheel.

3. A coupling arrangement as defined in claim 1, wherein the gearing element is a differential gear, said driving shaft engaging with said differential gear.

4. A coupling arrangement as defined in claim 1, wherein said cap nut has a first end section which is open and engaging with the worm gear mounted on the shaft of the motor, and a second end section which is closed and provided with a journal connected with said one end portion of said Cardan joint.

5. A coupling arrangement as defined in claim 4, wherein said one end portion of said Cardan joint has a connecting section; and further comprising a locking nut connecting said connecting section of said one end of said Cardan joint with said journal of said second end section of said cap nut.

6. A coupling arrangement as defined in claim 5, wherein said locking nut is threaded into said connecting section of said one end portion of said Cardan joint and has an inner opening in which said journal of said cap nut is received.

7. A coupling arrangement as defined in claim 1, wherein said structural element has two end faces, said driving shaft having one end section extending outwardly beyond one of said end faces of said structural element, and another end section extending outwardly beyond the other of said end faces of said structural element, one of said end sections of said driving shaft is provided with a worm gear engaging with the gearing element.

8. A coupling arrangement as defined in claim 7, wherein the other of said end sections of said driving shaft is connected with said other end portion of said Cardan joint.

9. A coupling arrangement as defined in claim 8, wherein said other end portion of said Cardan joint has a further connecting section; and further comprising a further locking nut connecting said further connecting section of said other end of said Cardan joint with said other end section of said driving shaft.

* * * * *